US011198572B2

(12) United States Patent
Tokoro

(10) Patent No.: US 11,198,572 B2
(45) Date of Patent: Dec. 14, 2021

(54) SHEET CONVEYING DEVICE AND IMAGE FORMING APPARATUS INCLUDING THE SAME

(71) Applicant: Brother Kogyo Kabushiki Kaisha, Nagoya (JP)

(72) Inventor: Yuji Tokoro, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/292,420

(22) Filed: Mar. 5, 2019

(65) Prior Publication Data

US 2019/0276253 A1 Sep. 12, 2019

(30) Foreign Application Priority Data

Mar. 12, 2018 (JP) ..... JP2018-044584

(51) Int. Cl.
*B65H 3/68* (2006.01)
*B65H 1/26* (2006.01)
(Continued)

(52) U.S. Cl.
CPC ..... *B65H 3/68* (2013.01); *B65H 1/266* (2013.01); *B65H 3/06* (2013.01); *B65H 5/06* (2013.01)

(58) Field of Classification Search
CPC . B65H 3/68; B65H 1/04; B65H 1/266; B65H 2404/611; B65H 3/44;
(Continued)

(56) References Cited

U.S. PATENT DOCUMENTS 5,294,106 A * 3/1994 Takagi ..... B65H 1/04 271/162
7,922,167 B2 * 4/2011 Kajiyama ..... B65H 5/025 271/10.01
(Continued)

FOREIGN PATENT DOCUMENTS

JP 08058995 A * 3/1996
JP 08059008 A * 3/1996
(Continued)

OTHER PUBLICATIONS

Japanese Notice of Reasons for Refusal (Application No. 2018-044584) dated Oct. 5, 2021 (with English translation).

*Primary Examiner* — Luis A Gonzalez
(74) *Attorney, Agent, or Firm* — Burr & Brown, PLLC

(57) ABSTRACT

A sheet conveying device includes a sheet feed tray. The sheet feed tray includes a first guide and a second guide. The first guide has a first end portion. The first end portion has a first area located in a central portion in a width direction, and a second area located closer to one end in the width direction than the first area. The first end portion is inclined such that the first area is downstream of the second area in the sheet conveying direction. The second guide has an upper end portion located downstream of the first end portion of the first guide in the sheet conveying direction and above the first end portion. The upper end portion has a third area located in a central portion in the width direction and a fourth area located closer to an end in the width direction than the third area.

8 Claims, 10 Drawing Sheets

(51) Int. Cl.
*B65H 5/06* (2006.01)
*B65H 3/06* (2006.01)

(58) Field of Classification Search
CPC ..... B65H 2405/332; B65H 5/38; B65H 3/06; B65H 5/06
See application file for complete search history.

(56) References Cited

U.S. PATENT DOCUMENTS

| | | | | |
|---|---|---|---|---|
| 2009/0001660 | A1* | 1/2009 | Miwa | B65H 1/26 271/226 |
| 2014/0084532 | A1 | 3/2014 | Asakawa | |
| 2015/0001793 | A1 | 1/2015 | Arimura et al. | |
| 2017/0210576 | A1* | 7/2017 | Kondo | B65H 1/04 |
| 2017/0283196 | A1 | 10/2017 | Hashimoto et al. | |

FOREIGN PATENT DOCUMENTS

| | | | | |
|---|---|---|---|---|
| JP | 10087099 | A | * | 4/1998 |
| JP | 2000-355430 | A | | 12/2000 |
| JP | 2006154557 | A | * | 6/2006 |
| JP | 2009-007123 | A | | 1/2009 |
| JP | 2014-061973 | A | | 4/2014 |
| JP | 2015-011093 | A | | 1/2015 |
| JP | 2017-178605 | A | | 10/2017 |

* cited by examiner

SHEET CONVEYING DEVICE AND IMAGE FORMING APPARATUS INCLUDING THE SAME

CROSS-REFERENCE TO RELATED APPLICATION

This application claims priority from Japanese Patent Application No. 2018-044584 filed on Mar. 12, 2018, the content of which is incorporated herein by reference in its entirety.

FIELD OF DISCLOSURE

Aspects disclosed herein relate to a sheet conveying device and an image forming apparatus including the sheet conveying device.

BACKGROUND

A known image forming apparatus includes a sheet conveying device with stacked upper and lower sheet feed trays.

The upper sheet feed tray includes a guide extending in a top-bottom direction or vertically and configured to guide a sheet fed from the lower tray.

SUMMARY

As the upper sheet feed tray partially defines a first path for conveying a sheet fed from the lower sheet feed tray and a second path for conveying a sheet fed from the upper sheet feed tray. As the first path and the second path join at the guide extending vertically, the second path has a gap at the guide. When a sheet fed from the upper sheet feed tray passes the gap or the guide, a trailing edge of the sheet may contact the guide with a tapping noise.

Such a gap may be left in an image forming apparatus for duplex printing, which defines a duplex path below a sheet feed tray.

Aspects disclosed herein relate to a sheet conveying device to reduce the tapping noise that may be produced by the trailing edge of a sheet and an image forming apparatus including the sheet conveying device.

According to one or more aspects disclosed herein, a sheet conveying device includes a sheet feed tray and a casing to which the sheet feed tray is detachably attached. The sheet feed tray is configured to accommodate a sheet. The sheet conveying device being configured to convey the sheet from the sheet feed tray toward the casing. The sheet feed tray includes a support portion configured to support the sheet, a first guide and a second guide. The first guide is disposed downstream of the support portion in a sheet conveying direction and configured to guide the sheet conveyed from the support portion. The first guide has a first end portion, which is a downstream end of the first guide. The first end portion has a first area and a second area. The first area is located in a central portion of the first end portion in a width direction orthogonal to the sheet conveying direction. The second area is located closer to one end, in the width direction, of the first end portion than the first area. The first end portion is inclined such that the first area is downstream of the second area in the sheet conveying direction. The second guide is configured to guide a sheet, which is conveyed from a lower level, upward. The second guide has an upper end portion. The upper end portion is located downstream of the first end portion of the first guide in the sheet conveying direction and above the first end portion. The upper end portion has a third area and a fourth area. The third area is located in a central portion of the upper end portion in the width direction. The fourth area is located closer to an end of the upper end portion in the width direction than the third area.

Thus, the sheet conveying device and the image forming apparatus including the sheet conveying device can reduce a tapping noise that may be produced by the trailing edge of a sheet.

DETAILED DESCRIPTION

An illustrative embodiment of the disclosure will be described with reference to the accompanying drawings.

Figure 1:
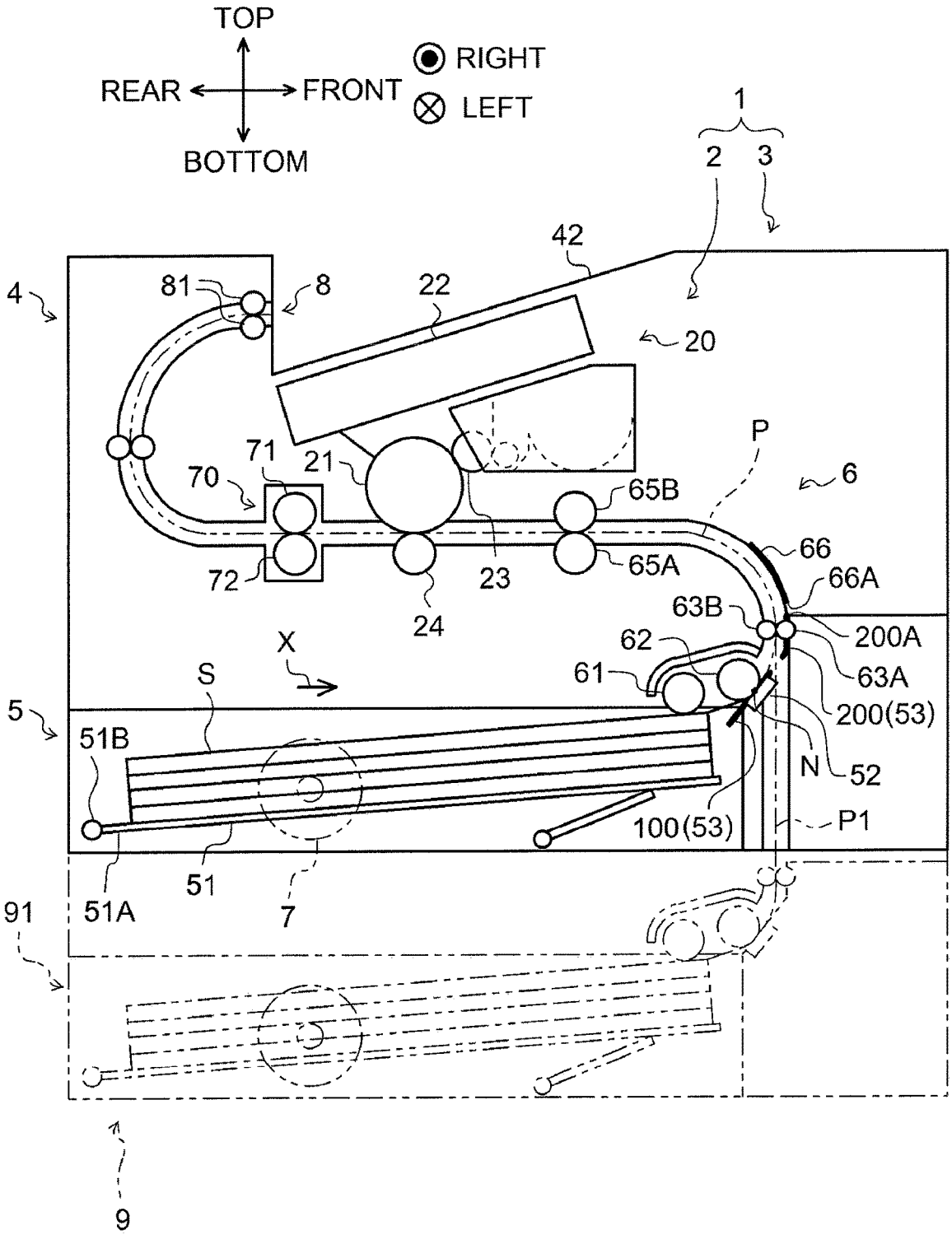
FIG. 1 is a cross sectional view of an image forming apparatus according to an illustrative embodiment of the disclosure.

In the following description, directions are defined based on FIG. 1. In FIG. 1, a right side is defined as a front or front side of the image forming apparatus 1, a left side is defined as a rear or rear side of the image forming apparatus 1, a side facing out of the page is defined as a left or left side of the image forming apparatus, a side facing into the page is defined as a right or right side of the image forming apparatus 1, an upper side is defined as a top or upper side of the image forming apparatus 1, and a lower side is defined as a bottom or lower side of the image forming apparatus 1.

Overall Structure of Image Forming Apparatus

An overall structure of an image forming apparatus 1 will be described with reference to FIG. 1.

The image forming apparatus 1 includes an image forming unit 2 configured to form an image on a sheet S, and a sheet conveying device 3 configured to convey a sheet to the image forming unit 2. The sheet conveying device 3 includes a casing 4, a sheet feed tray 5, a sheet feed unit 6, and a discharge unit 8.

The casing 4 is box-shaped and includes the sheet feed tray 5 in a lower portion of the casing 4.

The casing 4 accommodates inside the image forming unit 2, the sheet feed unit 6, and a motor 7 configured to drive the image forming unit 2.

The casing 4 has an upper surface defining a sheet discharge tray 42. The sheet discharge tray 42 is recessed downward and inclined downward from the front toward the rear.

The sheet feed unit 6 includes a separation roller 62, a separation pad 44, conveying rollers 63A, 63B, and registration rollers 65A, 65B.

The casing 4 defines inside a conveying path P extending from the sheet feed tray 5 via the image forming unit 2 to the sheet discharge tray 42. The sheet feed unit 6 feeds a sheet S supported on the sheet feed tray 5 along the conveying path P.

The sheet feed tray 5 is slidable in a direction parallel to an arrowed direction X from rear to front in the embodiment. The sheet feed tray 5 is detachably attached to the casing 4.

The sheet feed tray 5 includes, on its bottom surface, a sheet support plate 51 as an example of a support portion configured to support a sheet S. The sheet support plate 51 is pivotable about a rotation shaft 51B, which is disposed in an upstream end portion of the sheet support plate 51 in a sheet conveying direction in which a sheet is conveyed.

The sheet support plate 51 is configured to support a stack of sheets S thereon and pivot upward about the rotation shaft 51B to lift downstream ends of the sheets S in the sheet conveying direction.

The sheet feed tray 5 includes a separation pad 52 for separating sheets S one by one to convey a single sheet S along the conveying path P. The separation pad 52 is an example of a sheet separator configured to separate one or more sheets S one by one to convey a single sheet S.

The sheet feed tray 5 includes a chute 53 configured to guide a sheet S to be conveyed to the conveying path P.

The sheet feed unit 6 includes a feed roller 61, a separation roller 62, the conveying rollers 63A, 63B, and the registration rollers 65A, 65B. The feed roller 61 is configured to pick up a sheet S supported on the sheet feed tray 5. The separation roller 62 disposed downstream of the feed roller 61. The separation roller 62 and the separation pad 52 are configured to contact each other to form a nip N therebetween. The conveying rollers 63A, 63B are disposed downstream of the chute 53 and configured to convey a sheet S having passed through the nip N. The registration rollers 65A, 65B are disposed downstream of the conveying rollers 63A, 63B.

The chute 53 includes a first guide 100 and a second guide 200 disposed downstream of the first guide 100.

The first guide 100 and the second guide 200 are spaced apart from each other by a gap, which partially defines an auxiliary conveying path P1. The auxiliary conveying path P1 extends upward through the gap from a bottom surface of the casing 4 and joins into the conveying path P upstream of the conveying rollers 63A, 65B in the sheet conveying direction.

In the sheet feed unit 6, the feed roller 61 feeds a sheet S from the sheet feed tray 5, the separation roller 61 and the separation pad 62 separate the sheet S from subsequent sheets S, and thus the sheet S is singly conveyed toward the conveying path P.

The sheet S conveyed by the separation roller 62 and the separation pad 52 is guided upward by the chute 53 having a curved shape, and passes between the conveying rollers 63A, 63B. The sheet S is conveyed toward the image forming unit 2 by the registration rollers 65A, 65B disposed downstream of the conveying rollers 63A, 63B.

The registration rollers 65A, 65B temporarily stop the leading end of the sheet S, and then convey the sheet S toward the transfer position in the image forming unit 2 at a predetermined time.

The casing 4 includes a casing guide 66. The casing guide 66 is disposed downstream of the second guide 200 and configured to guide a sheet from the second guide 200 toward the registration rollers 65A, 65B.

The casing guide 66 has a second end 66A, which is an upstream end in the sheet conveying direction. The second end 66A is located above an upper end portion 200A of the second guide 200.

This structure prevents the casing guide 66 fixed in position to the casing 4 and the second guide 200 fixed in position to the sheet feed tray 5 from colliding with each other when the sheet feed tray 5 is slid in a horizontal direction.

The image forming unit 2 is disposed above the sheet feed tray 5, and includes a process cartridge 20 configured to transfer an image on a sheet S conveyed from the sheet feed unit 6, an exposure unit 22 configured to expose a surface of a photosensitive drum 21 in the process cartridge 20, and a fixing unit 70 configured to fix the image transferred on the sheet S by the process cartridge 20.

The process cartridge 20 includes a developing roller 23, the photosensitive drum 21, and a transfer roller 24.

The exposure unit 22 includes a laser diode, a polygon mirror, a lens, and a reflecting mirror, and is configured to emit a laser beam onto a surface of the photosensitive drum 21 based on image data inputted in the image forming apparatus 1 to expose the surface.

The photosensitive drum 21 is disposed adjacent to the developing roller 23.

The surface of the photosensitive drum 21 is positively and uniformly charged by a charger (not illustrated), and then exposed by the exposure unit 22.

Exposed areas on the surface of the photosensitive drum 21 are lower in electric potential than the other areas thereon, so that an electrostatic latent image is formed on the surface of the photosensitive drum 21 based on the image data.

The electrostatic latent image on the surface of the photosensitive drum 21 is developed into a visible developer image with positively charged toner supplied from the developing roller 23.

The transfer roller 24 is disposed facing the photosensitive drum 21 and receives a negative transfer bias from a bias applying member (not illustrated).

While a sheet S is nipped at a transfer position between the transfer roller 24 receiving the transfer bias and the photosensitive drum 21 carrying the developer image thereon, the developer image on the photosensitive drum 21 is transferred to the sheet S.

The fixing unit 70 includes a heat roller 71 and a pressure roller 3.

The heat roller 71 is driven by a drive force from the motor 7 and is heated by electric power supplied from a power source (not illustrated).

The pressure roller 72 is disposed facing the heat roller 71 and rotated by the rotation of the heat roller 71.

The sheet S having the developer image is conveyed to the fixing unit 70, in which the sheet S is nipped and conveyed by the heat roller 71 and the pressure roller 72, and thus the developer image is fixed onto the sheet S.

The discharge unit 8 includes discharge rollers 81, 81 and is configured to discharge the sheet conveyed from the fixing unit 70 outside of the casing 4.

More specifically, the discharge rollers 81, 81 are configured to discharge the sheet S conveyed from the fixing unit 70.

The image forming apparatus 1 of the embodiment may further include an additional sheet conveying device 9 below the casing 4.

In this case, a sheet S supported on a sheet feed tray 91 attached to the sheet conveying device 9 is conveyed through the auxiliary conveying path P1 and conveying path P and passes between the conveying rollers 63A, 63B. The sheet S is guided by the casing guide 66 and conveyed toward the registration rollers 65A, 65B.

Structure of Chute

A structure of the chute 53 will be described with reference to FIGS. 1 - 7.

As illustrated in FIG. 1, the chute 53 extends downstream from close to the separation roller 62 of the casing 4 in the sheet conveying direction. The chute 53 is disposed at the sheet feed tray 5 as a guide member for guiding a sheet S fed from the sheet feed tray 5 upward along a curved portion of the conveying path P.

The chute 53 is made up of the first guide 100 and the second guide 200 disposed downstream of the first guide 100.

Figure 2:
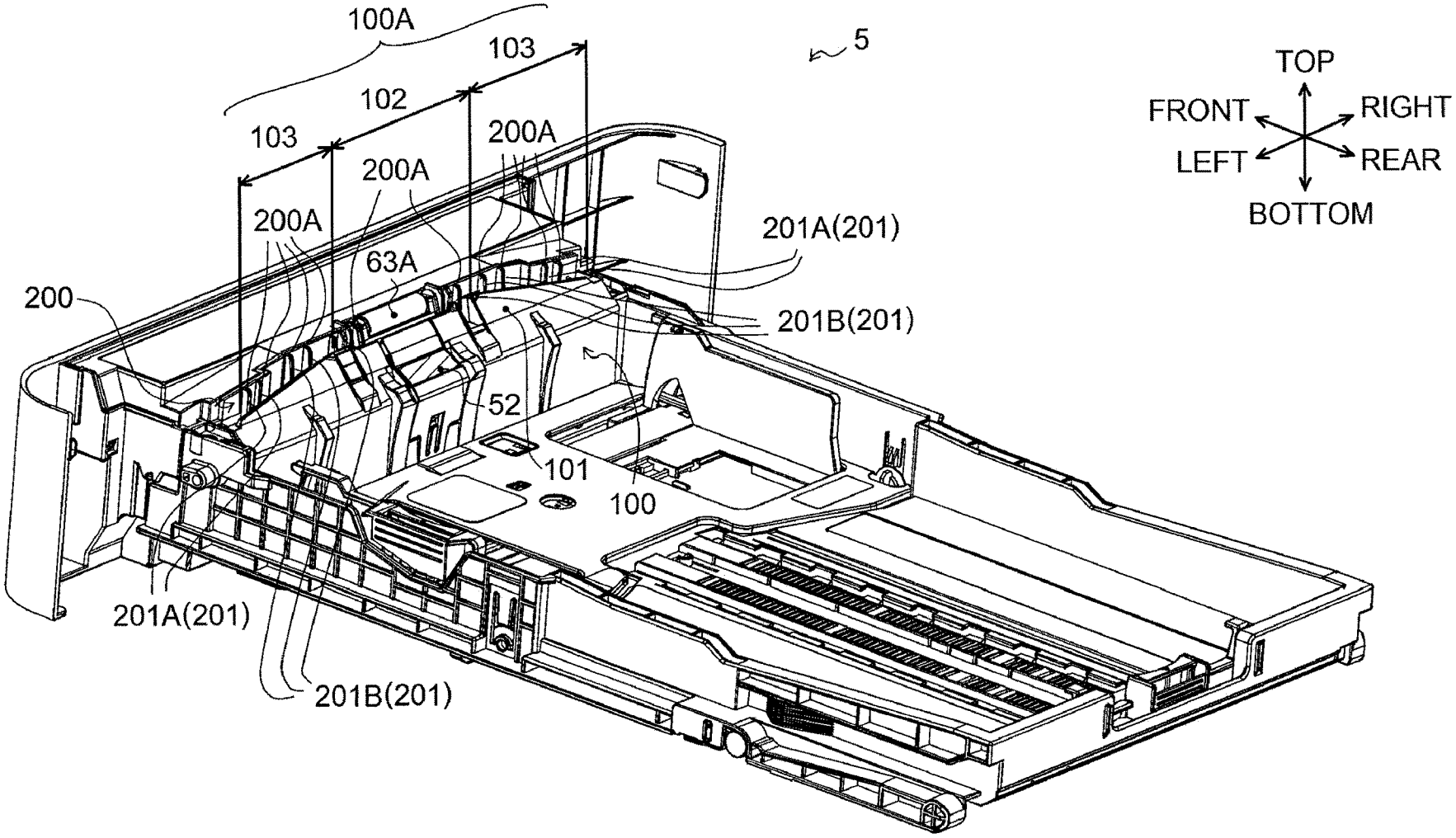
FIG. 2 is a perspective view of a sheet feed tray.

As illustrated in FIG. 2, the first guide 100 has an inclined surface 101 extending downstream in the sheet conveying direction (e.g., toward the front and upward in this embodiment) relative to a horizontal surface.

The first guide 100 includes a first end portion 100A, which is a downstream (or upper) end of the inclined surface 101. The first end portion 100A has a first area 102 and a second area 103. The first area 102 is located in a central portion of the first end portion 100A in a width direction (e.g., the left-right direction in the embodiment) orthogonal to the sheet conveying direction. The second area 103 is located closer to one end of the first end portion 100A in the width direction than the first area 102 is.

The first end portion 100A is inclined such that the first area 102 is downstream of the second area 103 in the sheet conveying direction, and higher and closer to the front than the second area 103 is.

In this embodiment, the first end portion 100A has another second area 103 located closer to the other end in the width direction, of the first end portion 100A than the first area 102 is. The first end portion 100A has a V shape such that the second areas 103 are inclined downstream toward the first area 102 in the sheet conveying direction.

The second guide 200 includes ribs 201. The ribs 201 extend vertically and are spaced apart from each other in a width direction orthogonal to the sheet conveying direction.

The second guide 200 with the ribs 201 reduces contact area with a sheet S (see FIG. 1) in comparison with that the second guide 200 would have no ribs or be a flat plate.

This reduces resistance to a sheet S to be conveyed and allows the second guide 200 to guide a sheet S passing through the first guide 100 toward the casing 4 smoothly.

Figure 3:
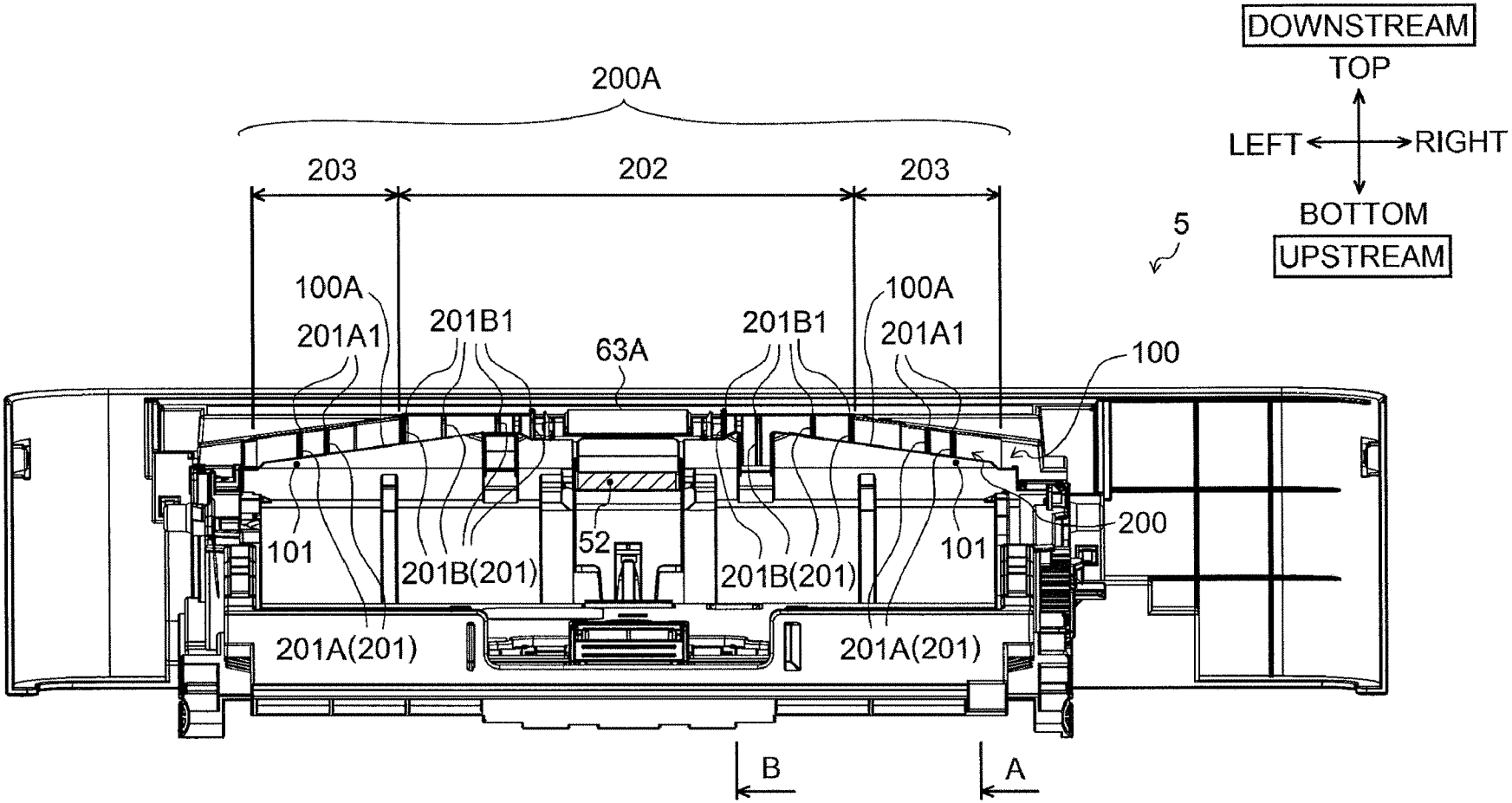
FIG. 3 is an enlarged rear view illustrating a first guide and a second guide in the sheet feed tray.

As illustrated in FIG. 3, the ribs 201 of the second guide 200 have their upper ends located downstream of the first end portion 100A of the first guide 100 in the sheet conveying direction and higher than the first end portion 100A of the first guide 100.

In other words, the second guide 200 made up of the ribs 201 extends vertically and is disposed such that the upper end portion 200A made up of upper end portions of the ribs 201 is located above and downstream of the first end portion 100A of the first guide 100 in the sheet conveying direction.

The second guide 200 is configured to guide, upward, a sheet S (see FIG. 1) conveyed along the auxiliary conveying path P1 from a lower level while being guided by the first guide 100.

Figure 6:
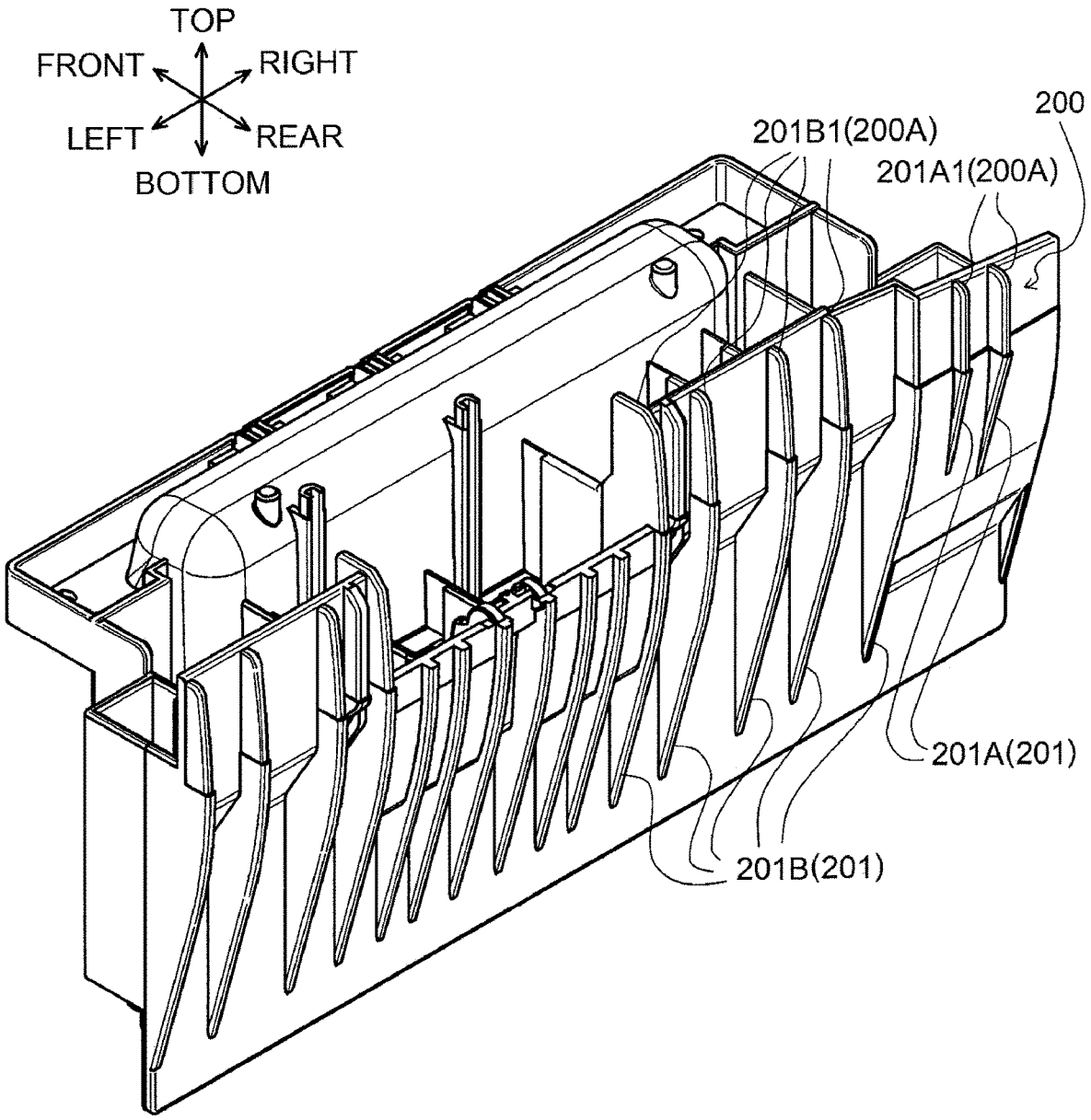
FIG. 6 is a perspective view of the second guide.

As illustrated in FIG. 6, the upper end portion 200A of the second guide 200 is made up of the upper end portions of the ribs 201. Each of the ribs 201 has a rounded corner near their upper end portions on the rear side.

In other words, the second guide 200 has a rounded corner near the upper end portion 200A.

This allows the second guide 200 to guide a sheet S (see FIG. 1) passing through the first guide 100 toward the casing 4 smoothly.

As illustrated in FIG. 3, the upper end portion 200A of the second guide 200 has a third area 202 and fourth areas 203. The third area 202 is located in a central portion of the upper end portion 200A in the width direction. Each of the fourth areas 203 is located closer to an end of the upper end 200 in the width direction than the third area 202 is.

Figure 4:
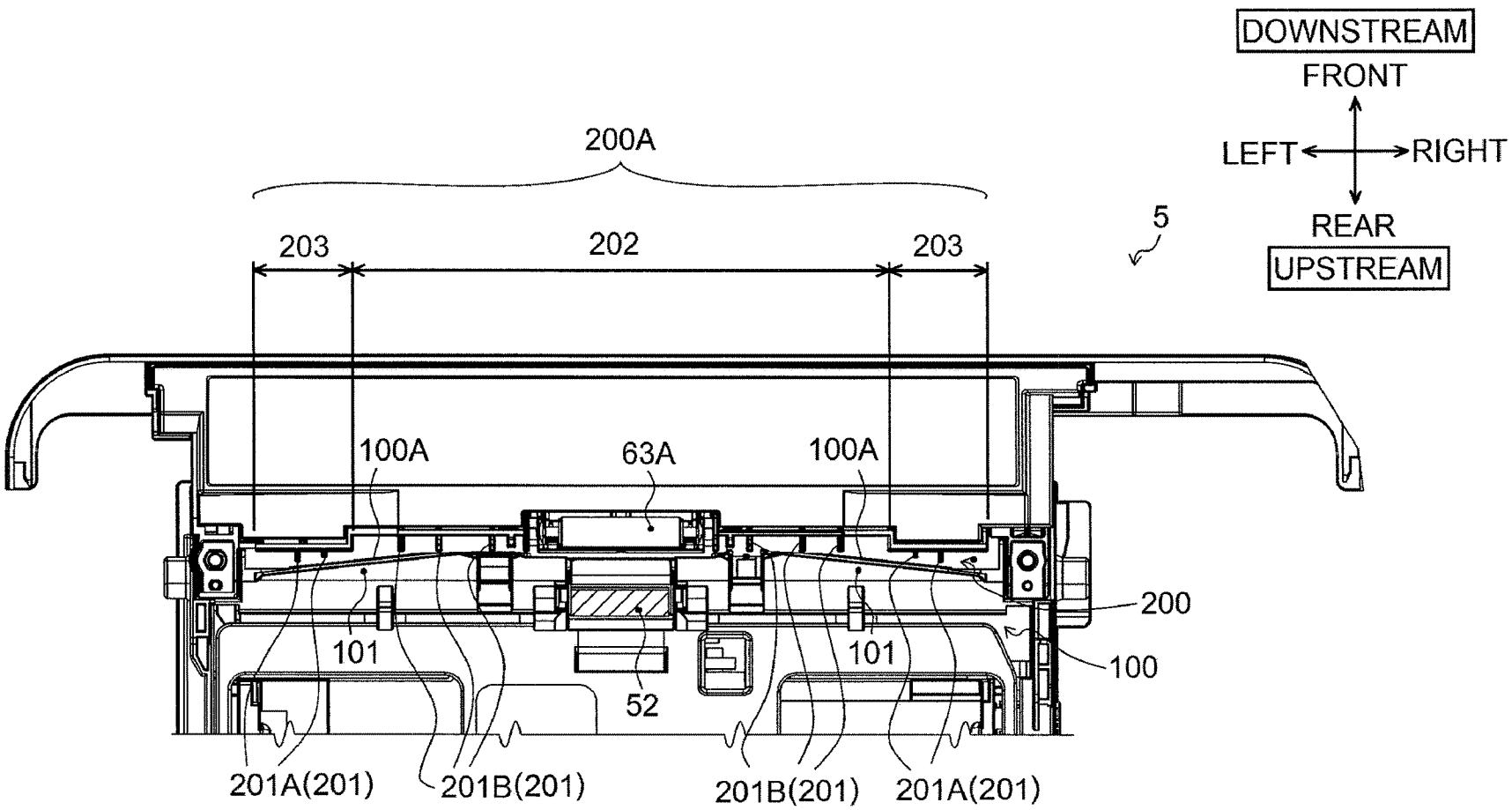
FIG. 4 is a partially enlarged top view illustrating the first guide and the second guide in the sheet feed tray.
Figure 7A:
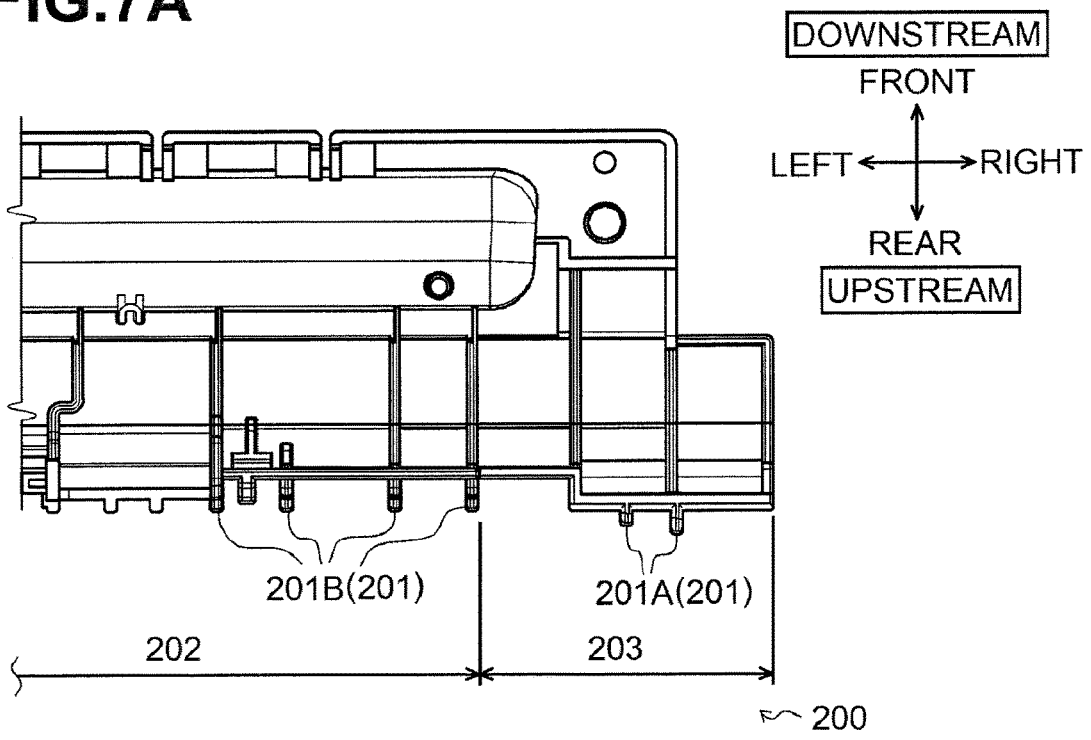
FIG. 7A is a partially enlarged top view illustrating a right half of the second guide.

As illustrated in FIGS. 4 and 7A, the ribs 201 in the fourth areas 203 (hereinafter referred to as "end ribs 201A," which are closer to an end of the second guide 200 in the width direction) are located upstream of the ribs 201 in the third area 202 (hereinafter referred to as "central ribs 201B" in the width direction) in the sheet conveying direction and closer to the rear than the central ribs 201B are.

In this embodiment, the upper end portion 200A of the second guide 200 is located downstream of the first end portion 100A of the first guide 100 in the sheet conveying direction and above the first end portion 100A of the first guide 100. The fourth areas 203 in both end portions of the upper end portion 200A in the width direction are located upstream of and closer to the rear than the third area 202 in the central portion of the upper end portion 200A is.

The first end portion 100A is inclined such that the first area 103 is downstream of the second areas 102 in the sheet conveying direction, and higher and closer to the front than the second areas 103 are. When the upstream or trailing edge of a sheet S (see FIG. 1) passes the first guide 100, both end portions of the trailing edge shift to and are supported by the second guide 200 in advance of the central portion of the trailing edge.

Figure 8:
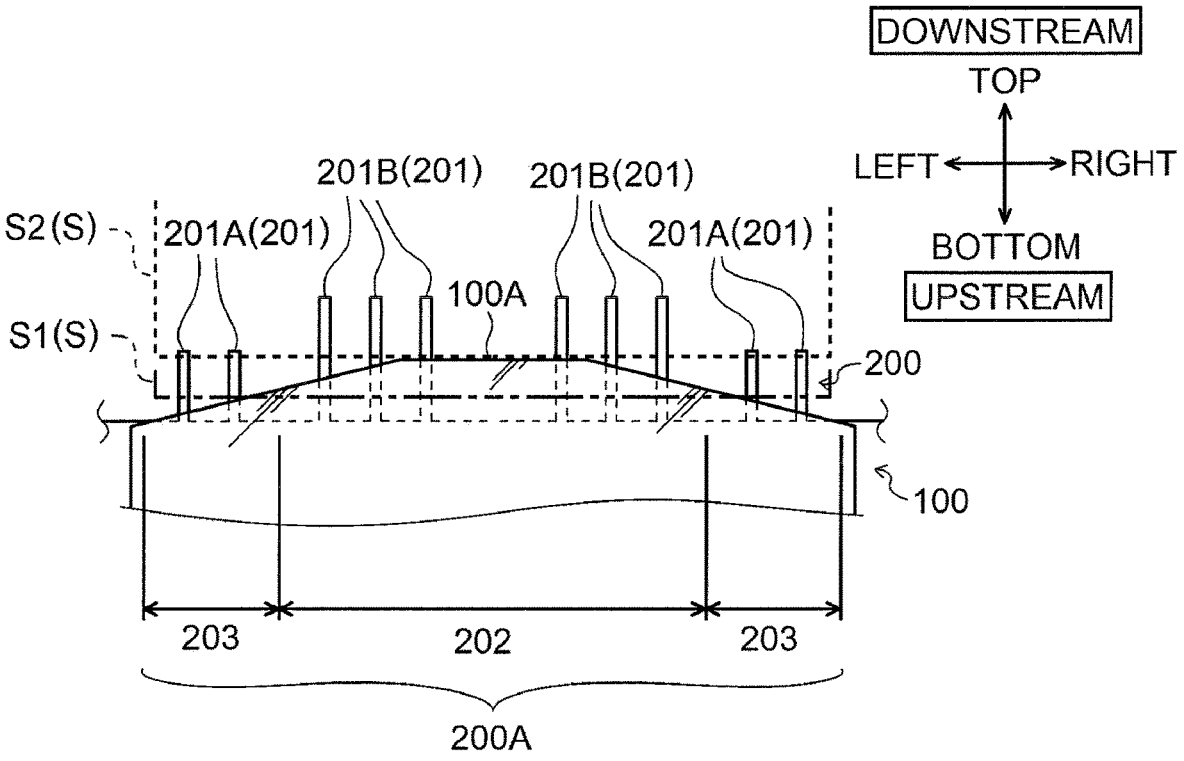
FIG. 8 is a schematic rear view illustrating time-varying positional changes of the trailing edge of a sheet conveyed from the first guide toward the second guide.

More specifically, as illustrated in FIG. 8, when a sheet S just start to pass the first guide 100, the trailing edge of the sheet S is located at a position corresponding to a trailing edge of a first sheet Si indicated by a double dotted line, and both end portions of the trailing edge of the sheet S in the width direction shift to and are supported at the fourth areas 203 of the second guide 200 in advance of a central portion of the trailing edge.

Subsequently, when the central portion of the trailing edge of the sheet S passes the first guide 100, the trailing edge of the sheet S is located at a position corresponding to a trailing edge of a second sheet S2 indicated by a dotted line. As both end portions of the trailing edge of the sheet S in the width direction are still supported at the fourth areas 203 of the second guide 200, stress applied to the trailing edge of the sheet S can be dispersed to reduce the tapping noise that may be produced when the trailing edge of the sheet S shifts to the second guide 200.

Figure 9:
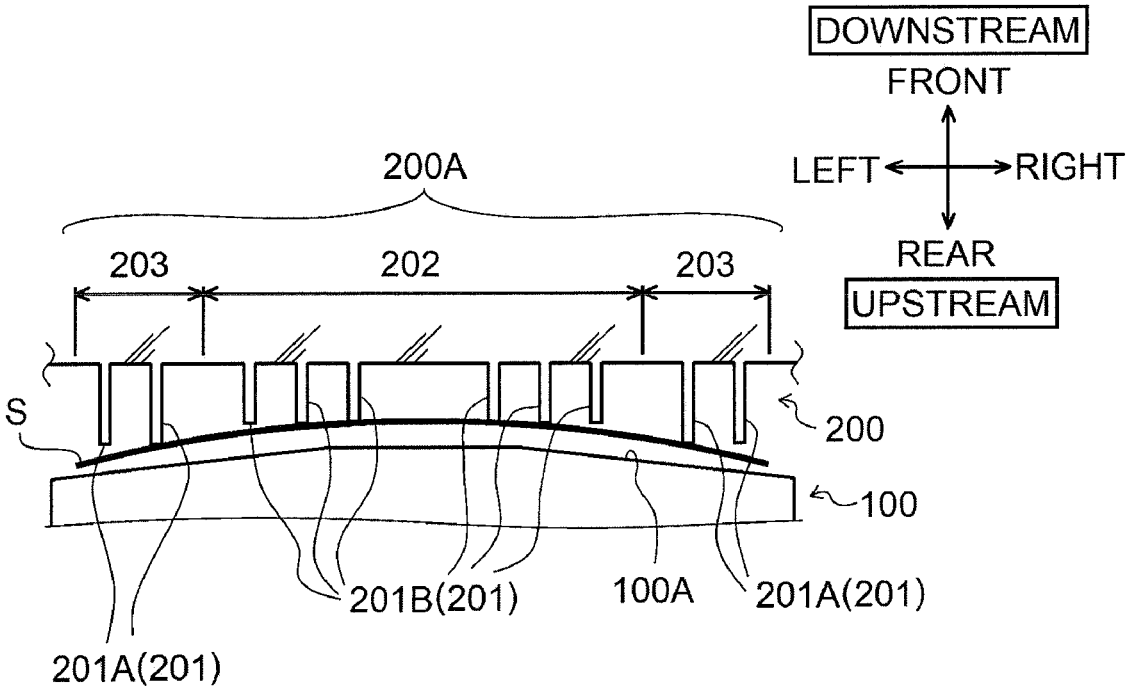
FIG. 9 is a schematic plan view illustrating a sheet conveyed between the first guide and the second guide.

This embodiment shows the additional sheet feed tray 91, which is added below the sheet feed tray 5 and includes a sheet feed tray 91 (FIG. 1). For example, a sheet S may be conveyed from the sheet feed tray 91 upward toward between the first guide 100 and the second guide 200. When the sheet S is then guided by the second guide 200, as illustrated in FIG. 9, the sheet S is supported by the fourth areas 203 of the second guide 200 and thus curves relative to the width direction such that it curves downstream in the sheet conveying direction (or curved toward the front).

This provides greater rigidity in the sheet S, thus stabilizing the position of the sheet S to be conveyed.

Figure 5B:
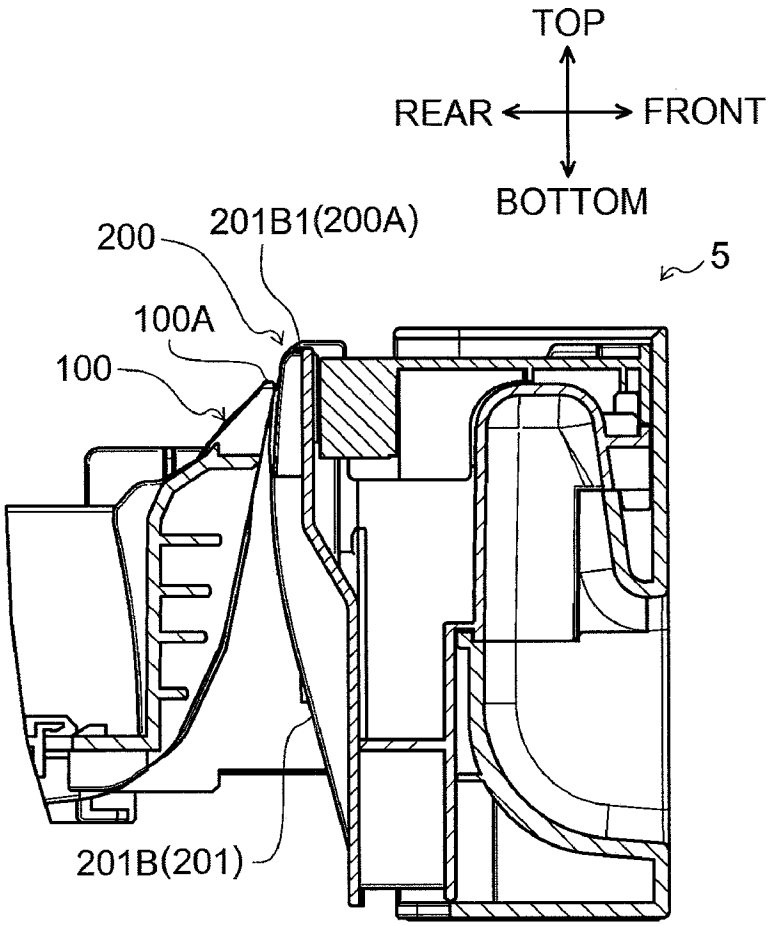
FIG. 5B is a partially enlarged sectional view illustrating the first guide and the second guide in the sheet feed tray, taken in a direction of arrow B in FIG. 3.
Figure 5A:
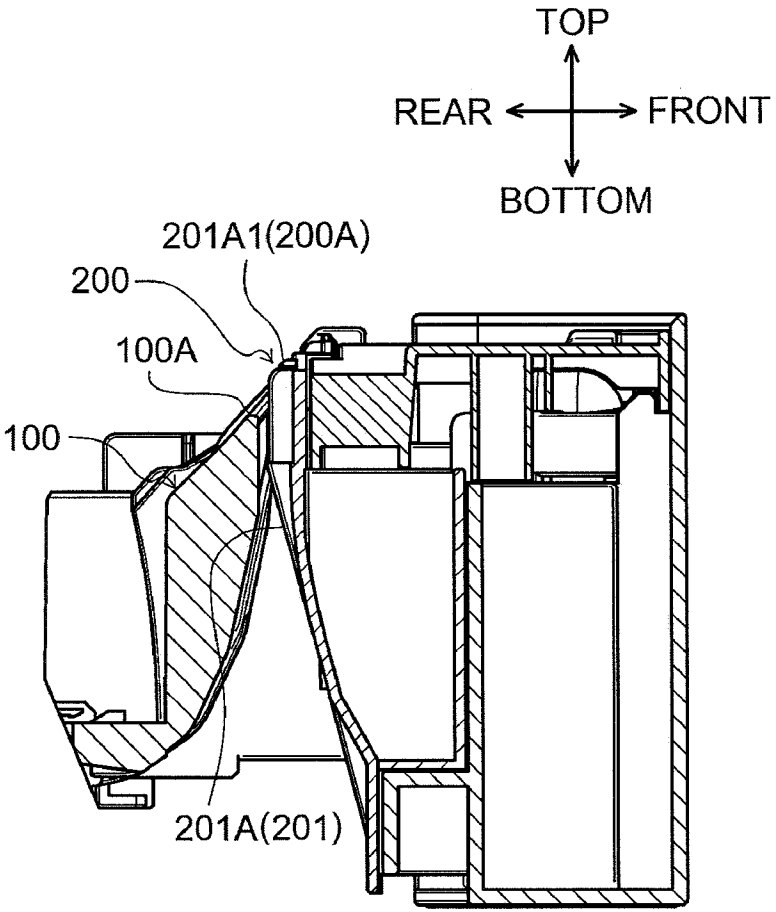
FIG. 5A is a partially enlarged sectional view illustrating the first guide and the second guide in the sheet feed tray, taken in a direction of arrow A in FIG. 3.
Figure 7B:
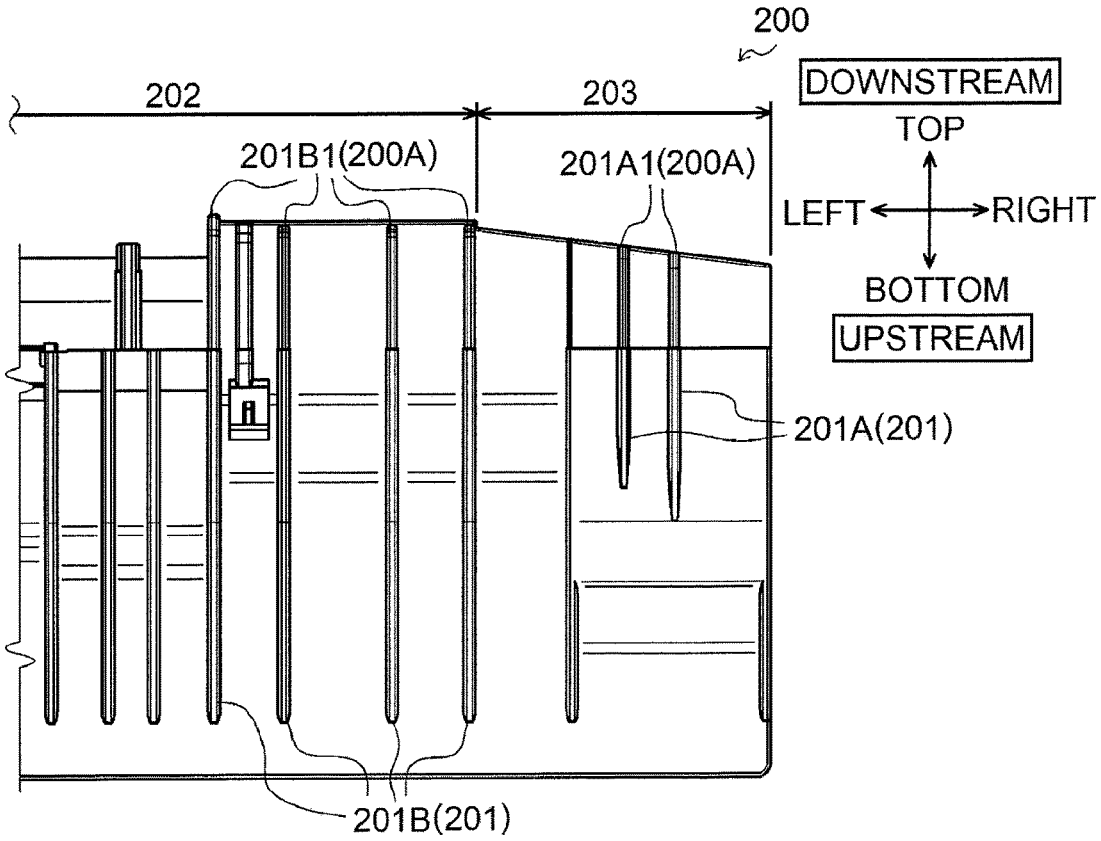
FIG. 7B is a partially enlarged rear view illustrating the right half of the second guide.

As illustrated in FIGS. 5A, 5B, and 7B, the end ribs 201A (see FIG. 5A) in the fourth area 203 of the second guide 200 have their upper ends 201A1, which are located below upper ends 201B1 of the central ribs 201B (see FIG. 5B) in the third area 202.

In other words, the second guide 200 have the upper end portion 200A such that the fourth areas 203 are upstream of the third area 202 in the sheet conveying direction or below the third area 202.

The upper end portion 200A of the second guide 200 is located above the first end portion 100A of the first guide 100. When a sheet S shifts from the first guide 100 to the second guide 200, the leading or front end of the sheet S may collide with the second guide 200, and thus bend.

In this embodiment, however, the upper end portion 200A of the second guide 200 is shaped such that the fourth areas 203 at both end portions of the upper end portion 200A in the width direction are located upstream of the third area 202 at the central portion of the upper end portion 200A. Before the central portion of the leading end of the sheet S reaches the third area 202 of the second guide 200, both end portions of the leading end of the sheet S pass the fourth areas 203 of the second guide 200.

Figure 10A:
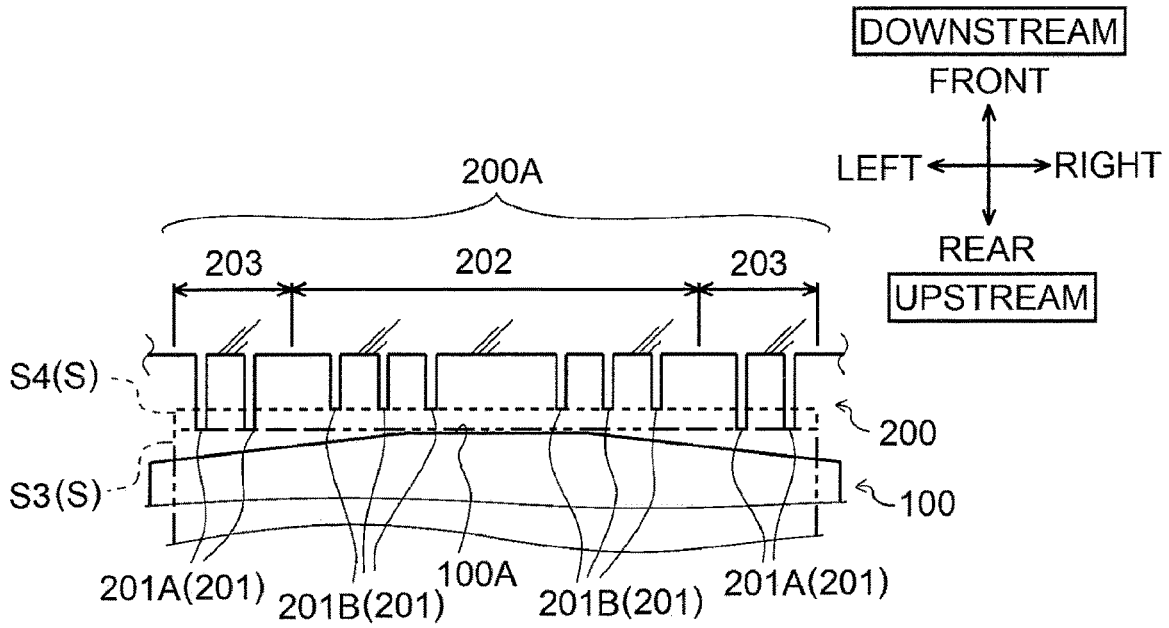
FIG. 10A is a schematic plan view illustrating time-varying positional changes of the leading edge of a sheet conveyed from the first guide toward the second guide.
Figure 10B:
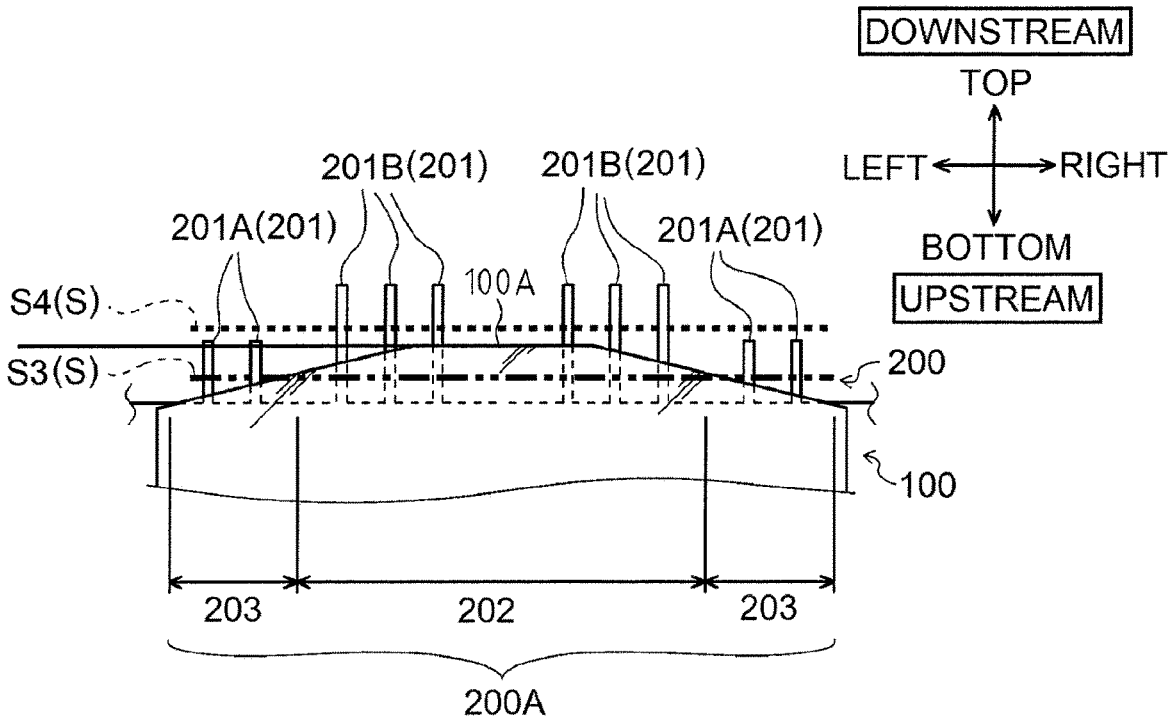
FIG. 10B is a schematic rear view illustrating time-varying positional changes of the leading edge of a sheet conveyed from the first guide toward the second guide.

More specifically, as illustrated in FIGS. 10A and 10B, when a sheet S just reaches the second guide 200, the leading end of the sheet S is located at a position corresponding to a leading end of a third sheet S3 indicated by a double dotted line, and both end portions of the leading end of the sheet S in the width direction are in contact with the fourth areas 203 of the second guide 200.

Thereafter, the sheet S is further conveyed and contacts the third area 202 of the second guide 200. In this state, the leading end of the sheet S is located at a position corresponding to a leading end of a fourth sheet S4 indicated by a dashed line, and both end portions of the leading end of the sheet S in the width direction pass apart from the fourth areas 203 of the second guide 200.

This prevents the entire leading end of the sheet S from contacting the second guide 200, enables a part of the leading end of the sheet S to contact the second guide 200, and thus reduces the leading end of the sheet S from bending.

The sheet feed tray 5 includes the separation pad 52 (see FIG. 1) configured to separate sheets S one by one to convey a single sheet S. As illustrated in FIG. 2, the separation pad 52 is disposed within an area of the first guide 100 corresponding to the first area 102 of the first end portion 100A in the width direction.

This structure enables the separation pad 52 to separate sheets conveyed from the sheet feed tray 5 one by one, thus preventing a few sheets S from being conveyed toward the conveyance path P at a time.

As illustrated in FIG. 3, the second guide 200 includes a conveying roller 63A disposed within the third area 202 of the upper end portion 200A in the width direction.

In other words, the sheet feed tray 5 includes the conveying roller 63A, which is disposed downstream of the separation pad 52 and the first end portion 100A of the first guide 100 in the sheet conveying direction and in front of and above the separation pad 52 and the first end portion 100A of the first guide 100.

This structure allows the conveying roller 63A to function as a dust removing roller to remove foreign matter such as dust from a sheet S, thus preventing foreign matter from entering the casing 4. This structure also allows the first guide 100 to guide a sheet S to the second guide 200.

Effects

The sheet conveying device 3 of the embodiment includes the casing 4 and the sheet feed tray 5, which is slidable and detachably attached to the casing 4. The sheet conveying device 3 is configured to convey a sheet S supported at the sheet feed tray 5 toward the casing 4.

The sheet feed tray 5 includes the sheet support plate 51, which is configured to support one or more sheets S, and the first guide 100 and the second guide 200, which are configured to guide a sheet S conveyed from the sheet support plate 51.

The first guide 100 has the first end portion 100, which is inclined such that the first area 102 is downstream of the second areas 103 in the sheet conveying direction.

The second guide 200 extends vertically, has the upper end portion 200A located downstream of the first guide 100 in the sheet conveying direction, and is configured to guide a sheet S (see FIG. 1) conveyed from the first guide 100 upward.

The upper end portion 200A of the second guide 200 is located above the first end portion 100A of the first guide 100. The upper end portion 100A has the third area 202 located at the central portion, and the fourth areas 203 located adjacent to opposite ends of the third area 202 and upstream of the third area 202 in the sheet conveying direction.

The image forming apparatus 1 of the embodiment is configured as described above.

The image forming apparatus 1 includes the image forming unit 2 configured to form an image on a sheet S, and the sheet conveying device 3 configured to convey a sheet to the image forming unit 2.

The first end portion 100A of the first guide 100 is inclined such that the first area 103 is downstream of the second areas 102 in the sheet conveying direction, and higher and closer to the front than the second areas 103 are. When the upstream or trailing edge of a sheet S (see FIG. 1) passes the first guide 100, however, both end portions of the trailing edge shift to and are supported by the second guide 200.

Subsequently, when a central portion of the trailing edge of the sheet S passes the first guide 100, both end portions of the trailing edge of the sheet S in the width direction are supported at the second guide 200, and thus stress applied to the trailing edge of the sheet S can be dispersed to reduce the tapping noise that may be produced when the trailing edge of the sheet S shifts to the second guide 200.

This embodiment shows that, when a sheet S is conveyed from the sheet feed tray 91 of the additional sheet conveying device 9 upward toward between the first guide 100 and the second guide 200, the sheet S is supported at the fourth areas 203 of the second guide 200 and thus curves relative to the width direction.

This provides greater rigidity in the sheet S, and thus stabilizes the position of the sheet S to be conveyed.

In the sheet conveying device 3, the second guide 200 has the upper end portion 200A where the fourth areas 203 are located below the third area 202.

With this positional relationship, when a central portion of the leading end of a sheet S reaches the third area 202 of the second guide 200, both end portions of the leading end of the sheet S pass the fourth areas 203 of the second guide 200.

This prevents the entire leading end of the sheet S from contacting the second guide 200 or enables a part of the leading end of the sheet S to contact the second guide 200, and thus reduces the leading end of the sheet S from bending.

In the sheet conveying device 3 of the embodiment, the casing 4 includes the casing guide 66, which is disposed downstream of the second guide 200 and configured to guide a sheet S conveyed from the second guide 200. The casing guide 66 has the second end 66A, which is an upstream end in the sheet conveying direction. The second end 66A is located above the upper end portion 200A of the second guide 200.

This structure prevents the casing guide 66 fixed in position to the casing 4 and the second guide 200 fixed in position to the sheet feed tray 5 from colliding with each other when the sheet feed tray 5 is slid in a horizontal direction.

In the sheet conveying device 3 of the illustrative embodiment, the second guide 200 has a rounded corner near the upper end portion 200A.

This allows the second guide 200 to guide a sheet S passing through the first guide 100 toward the casing 4 smoothly.

In the sheet conveying device 3, the second guide 200 includes the ribs 201 extending vertically and being spaced apart from each other in the width direction.

The second guide 200 with the ribs 201 reduces contact area with a sheet S in comparison with the second guide 200 without ribs.

This reduces resistance to a sheet S to be conveyed and allows the second guide 200 to guide a sheet S passing through the first guide 100 toward the casing 4 smoothly.

In the sheet conveying device 3 of the embodiment, the sheet feed tray 5 includes the separation pad 52 for separating sheets S one by one to convey a single sheet S. The separation pad 52 is disposed within an area of the first guide 100 corresponding to the first area 102 of the first end portion 100A in the width direction.

This structure enables the separation pad 52 to separate sheets conveyed from the sheet feed tray 5 one by one, thus preventing a few sheets S from being conveyed toward the conveyance path P at a time.

In the sheet conveying device 3 of the embodiment, the sheet feed tray 5 includes the conveying roller 63A, which is disposed downstream of the separation pad 52 and the first end portion 100A of the first guide 100 in the sheet conveying direction and in front of and above the first end portion 100A of the first guide 100.

This structure allows the conveying roller 63A to function as a dust removing roller to remove foreign matter such as dust from a sheet S, thus preventing foreign matter from entering the casing 4. This structure also allows the first guide 100 to guide a sheet S to the second guide 200.

What is claimed is:

1. A sheet conveying device, comprising:

a sheet feed tray; and a casing to which the sheet feed tray is detachably attached, wherein the sheet feed tray is configured to accommodate a sheet, the sheet conveying device being configured to convey the sheet from the sheet feed tray toward the casing, wherein the sheet feed tray includes a support portion configured to support the sheet, a first guide disposed downstream of the support portion in a sheet conveying direction and configured to guide the sheet conveyed from the support portion, the first guide having a first end portion, which is a downstream end of the first guide, the first end portion having a first area and a second area, the first area being located in a central portion of the first end portion in a width direction orthogonal to the sheet conveying direction, the second area being located closer to an end, in the width direction, of the first end portion than the first area, and the first end portion being shaped such that the second area is inclined downstream to the first area in the sheet conveying direction, and a second guide configured to guide a sheet, which is conveyed from a lower level, upward, the second guide having an upper end portion, the upper end portion being located downstream of the first end portion of the first guide in the sheet conveying direction and above the first end portion, the upper end portion having a third area and a fourth area, the third area and the fourth area of the upper end portion of the second guide being located above the first end portion, the third area being located in a central portion of the upper end portion in the width direction, the fourth area being located closer to an end of the upper end portion in the width direction than the third area, and wherein the second guide has the upper end portion where the fourth area is located below the third area.

2. The sheet conveying device according to claim 1, wherein the casing includes a casing guide disposed downstream of the second guide of the sheet feed tray and configured to guide the sheet conveyed from the second guide, and wherein the casing guide has a second end, which is an upstream end in the sheet conveying direction, the second end being located above the upper end portion of the second guide.

3. The sheet conveying device according to claim 1, wherein the second guide has a rounded corner near the upper end portion.

4. The sheet conveying device according to claim 1, wherein the second guide includes a plurality of ribs extending vertically and spaced apart from each other in the width direction.

5. The sheet conveying device according to claim 1, wherein the sheet feed tray includes a sheet separator configured to separate one or more sheets one by one to convey a single sheet, the sheet separator being disposed within an area of the first guide corresponding to the first area.

6. The sheet conveying device according to claim 5, wherein the sheet feed tray includes a roller disposed downstream of the sheet separator and the first end portion of the first guide in the sheet conveying direction.

7. An image forming apparatus comprising:

an image forming unit configured to form an image on a sheet; and the sheet conveying device according to claim 1 configured to convey the sheet to the image forming unit.

8. A sheet feed tray comprising:

a support portion configured to support a sheet to be conveyed in a sheet conveying direction;

a first guide disposed downstream of the support portion in the sheet conveying direction and configured to guide the sheet conveyed from the support portion, the first guide having a first end portion, which is a downstream end of the first guide, the first end portion having a first area and a second area, the first area being located in a central portion of the first end portion in a width direction orthogonal to the sheet conveying direction, the second area being located closer to an end, in the width direction, of the first end portion than the first area, and the first end portion being shaped such that the second area is inclined downstream to the first area in the sheet conveying direction; and a second guide configured to guide the sheet upward, the second guide having an upper end portion, the upper end portion being located downstream of the first end portion of the first guide in the sheet conveying direction and above the first end portion, the upper end portion having a third area and a fourth area, the third area and the fourth area of the upper end portion of the second guide being located above the first end portion, the third area being located in a central portion of the upper end portion in the width direction, the fourth area being located closer to an end of the upper end portion in the width direction than the third area, wherein the second guide has the upper end portion where the fourth area is located below the third area.

* * * * *